US008203129B2

(12) United States Patent
Slinkard et al.

(10) Patent No.: US 8,203,129 B2
(45) Date of Patent: Jun. 19, 2012

(54) METHODS AND APPAREL FOR ATTENUATING ELECTROMAGNETIC FIELDS EMANATING FROM A PERSON IN OR ON A BODY OF WATER

(76) Inventors: Michael D. Slinkard, John Day, OR (US); John M. Maupin, John Day, OR (US)

( * ) Notice: Subject to any disclaimer, the term of this patent is extended or adjusted under 35 U.S.C. 154(b) by 80 days.

(21) Appl. No.: 12/549,698

(22) Filed: Aug. 28, 2009

(65) Prior Publication Data

US 2011/0073361 A1 Mar. 31, 2011

(51) Int. Cl.
*G21F 3/02* (2006.01)

(52) U.S. Cl. ..... 250/516.1; 250/515.1; 428/15; 428/17; 428/207; 2/69

(58) Field of Classification Search ..... None
See application file for complete search history.

(56) References Cited

U.S. PATENT DOCUMENTS

| | | | | |
|---|---|---|---|---|
| 3,380,087 | A | 4/1968 | Petty et al. | |
| 3,822,403 | A * | 7/1974 | Coleman et al. | 455/40 |
| 4,211,980 | A | 7/1980 | Stowell | |
| 4,653,473 | A * | 3/1987 | Kempe | 128/846 |
| 4,825,877 | A * | 5/1989 | Kempe | 128/846 |
| 4,868,580 | A * | 9/1989 | Wade | 343/912 |
| 4,926,910 | A * | 5/1990 | Wade | 139/425 R |
| 5,097,885 | A | 3/1992 | Kitagawa | |
| 5,103,504 | A | 4/1992 | Dordevic | |
| 5,203,033 | A | 4/1993 | Sheppard et al. | |
| D337,366 | S | 7/1993 | Baker | |
| D350,399 | S | 9/1994 | Bodrie | |
| 5,377,711 | A | 1/1995 | Mueller | |
| 5,521,655 | A | 5/1996 | Rhoad | |
| 5,573,857 | A | 11/1996 | Auger | |
| 5,578,359 | A * | 11/1996 | Forbes et al. | 428/131 |
| 5,621,188 | A | 4/1997 | Lee et al. | |
| 5,675,838 | A | 10/1997 | Hollinger | |
| 5,676,812 | A | 10/1997 | Kadokura | |
| 5,767,933 | A | 6/1998 | Hagan | |

(Continued)

FOREIGN PATENT DOCUMENTS

DE 3217977 A * 11/1983

(Continued)

OTHER PUBLICATIONS

International Search Report and Written Opinion of the International Searching Authority in co-owned App No. PCT/US2010/032133.

(Continued)

*Primary Examiner* — David A Vanore
*Assistant Examiner* — Andrew Smyth
(74) *Attorney, Agent, or Firm* — David S. Alavi

(57) ABSTRACT

Attenuating, while in or on a body of water, one's own emanated electromagnetic field by wearing apparel that includes an electromagnetically shielding fabric. The shielding fabric comprises a substantially continuous system of conductive fibers combined with non-conductive fabric. Or attenuating, while a person is in or on a body of water, the electromagnetic field emanated by the person, by (i) providing to the person apparel that includes the electromagnetically shielding fabric, and (ii) instructing the person to wear it while in or on the water. The attenuation of the emanated electromagnetic field decreases the likelihood of a person being located in the body of water by a water-borne predator detecting that person's emanated electromagnetic field.

23 Claims, 6 Drawing Sheets

U.S. PATENT DOCUMENTS

| | | | | |
|---|---|---|---|---|
| 5,935,706 | A | 8/1999 | Hoover et al. | |
| 5,968,854 | A | 10/1999 | Akopian et al. | |
| 5,983,913 | A | 11/1999 | Fargason | |
| 6,061,828 | A | 5/2000 | Josephs | |
| 6,127,022 | A * | 10/2000 | Pretorius | 428/195.1 |
| 6,134,718 | A | 10/2000 | Sesselmann | |
| 6,146,351 | A * | 11/2000 | Kempe | 602/75 |
| 6,265,466 | B1 * | 7/2001 | Glatkowski et al. | 523/137 |
| 6,269,489 | B1 | 8/2001 | Heath | |
| 6,299,812 | B1 | 10/2001 | Newman | |
| 6,539,966 | B2 | 4/2003 | Raines et al. | |
| 6,632,499 | B1 | 10/2003 | Marks et al. | |
| 6,694,995 | B1 * | 2/2004 | Ransom | 135/128 |
| 6,868,854 | B2 * | 3/2005 | Kempe | 128/849 |
| 6,941,961 | B1 | 9/2005 | Eastman | |
| 7,100,626 | B2 | 9/2006 | Livacich | |
| 7,134,857 | B2 | 11/2006 | Andrady | |
| 7,182,091 | B2 | 2/2007 | Maddox | |
| 7,196,023 | B2 | 3/2007 | Langley et al. | |
| 7,208,115 | B2 | 4/2007 | Sheridan | |
| 7,354,877 | B2 * | 4/2008 | Rosenberger et al. | 442/194 |
| 7,565,909 | B2 | 7/2009 | Reis et al. | |
| 2001/0000849 | A1 * | 5/2001 | Siman-Tov et al. | 62/259.3 |
| 2002/0069449 | A1 | 6/2002 | Blutstein et al. | |
| 2002/0069904 | A1 | 6/2002 | Robinson | |
| 2003/0233694 | A1 * | 12/2003 | Wescombe-Down | 2/2.15 |
| 2004/0053780 | A1 * | 3/2004 | Jiang et al. | 502/182 |
| 2004/0068415 | A1 * | 4/2004 | Solomon | 705/1 |
| 2004/0107474 | A1 * | 6/2004 | Sesselmann | 2/69 |
| 2004/0188890 | A1 * | 9/2004 | Sheridan et al. | 264/510 |
| 2004/0207566 | A1 * | 10/2004 | Essig et al. | 343/878 |
| 2004/0209051 | A1 * | 10/2004 | Santos et al. | 428/195.1 |
| 2006/0033674 | A1 * | 2/2006 | Essig et al. | 343/912 |
| 2006/0094315 | A1 * | 5/2006 | Brodsky | 441/80 |
| 2006/0147698 | A1 * | 7/2006 | Carroll et al. | 428/316.6 |
| 2006/0170221 | A1 | 8/2006 | Wobben | |
| 2006/0264137 | A1 | 11/2006 | Ishihara et al. | |
| 2007/0226868 | A1 | 10/2007 | Hunt | |
| 2009/0184269 | A1 * | 7/2009 | Rees | 250/516.1 |

FOREIGN PATENT DOCUMENTS

| | | | |
|---|---|---|---|
| DE | 3217977 | A1 * | 11/1983 |
| EP | 1 096 604 | | 5/2001 |
| EP | 1096604 | A1 * | 5/2001 |
| JP | 10046443 | A * | 2/1998 |
| JP | 2002-054055 | | 2/2002 |
| KR | 10-1994-0010630 | | 10/1994 |
| KR | 10-2000-0007920 | | 2/2000 |
| KR | 10-2003-0061535 | | 7/2003 |
| KR | 10-0433389 | | 5/2004 |
| KR | 20-0416156 | | 5/2006 |
| WO | WO 90/09473 | | 8/1990 |
| WO | WO 97/48964 | | 12/1997 |
| WO | WO 9748964 | A1 * | 12/1997 |
| WO | WO 2010/124145 | | 10/2010 |

OTHER PUBLICATIONS

Office action dated Dec. 10, 2010 in co-owned U.S. Appl. No. 12/428,763.

Office Action dated Feb. 7, 2011 in co-owned U.S. Appl. No. 12/347,971.

Office Action dated Oct. 14, 2011 in co-owned U.S. Appl. No. 12/347,971.

U.S. Appl. No. 12/347,967, filed Dec. 31, 2008, Slinkard et al.

U.S. Appl. No. 12/347,971, filed Dec. 31, 2008, Slinkard et al.

U.S. Appl. No. 12/428,763, filed Apr. 23, 2009, Slinkard et al.

Loscher et al; Conspicuous behavioral abnormalities in a dairy cow herd near a TV and Radio transmitting antenna; Practical Veterinary Surgeon vol. 79 No. 5 p. 437 (1998).

Trzeciak et al; Behavioral effects of long-term exposure to magnetic fields in rats; Bioelectromagnetics vol. 14 No. 4 p. 297 (1993).

U.S. Appl. No. 12/701,169, filed Feb. 5, 2010, Slinkard et al.

U.S. Appl. No. 12/710,169, filed Feb. 5, 2010, Slinkard et al.

Pyrek, Kelly M.; Antimocrobials: Healthcare's Silver Bullet Against HAIs?; www.infenctioncontroltoday.com; online article posted Aug. 28, 2008.

Office Action dated Sep. 3, 2010 in co-owned U.S. Appl. No. 12/347,971.

Reply dated Nov. 23, 2010 in co-owned U.S. Appl. No. 12/347,971.

* cited by examiner

FIG. 4A
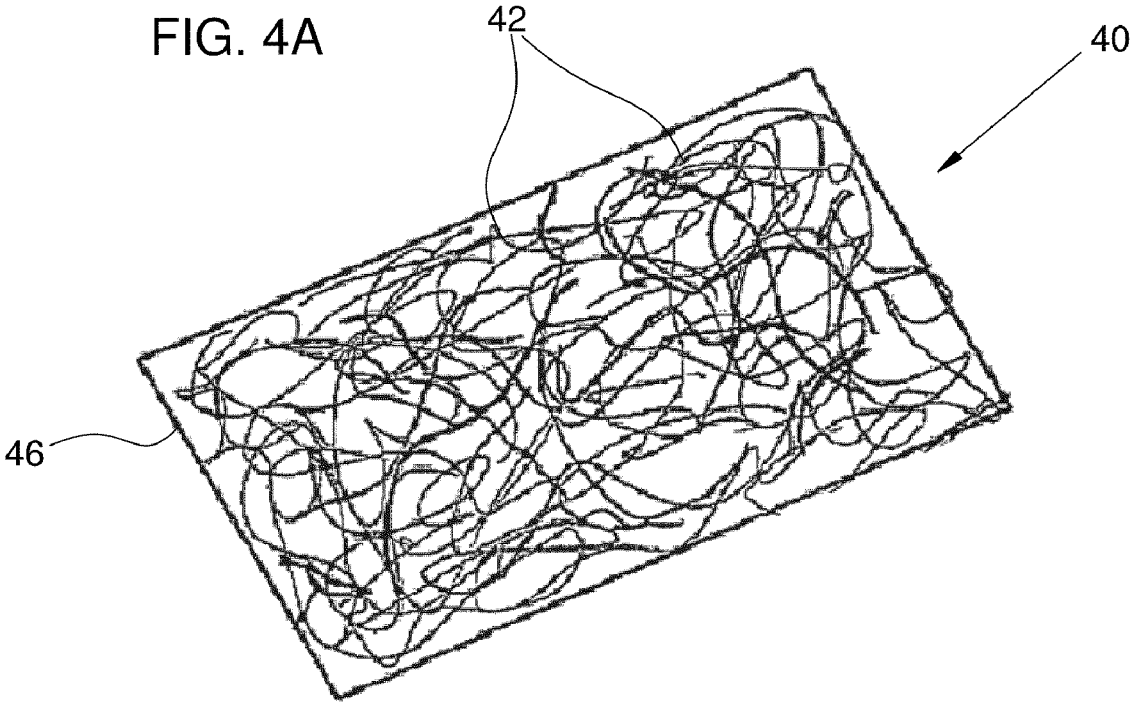
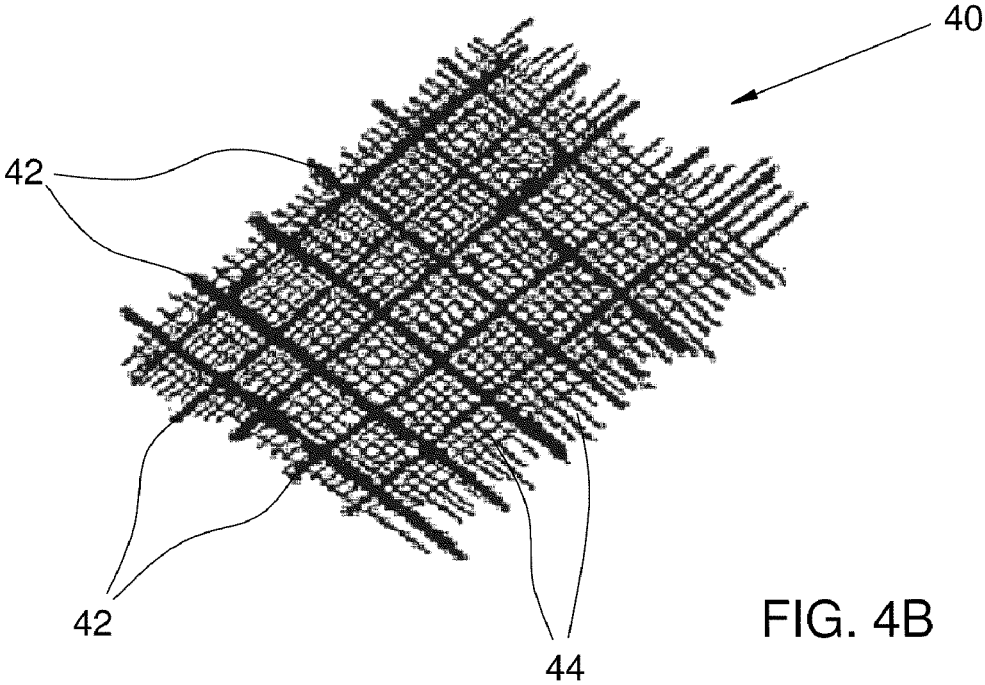
FIG. 4B

METHODS AND APPAREL FOR ATTENUATING ELECTROMAGNETIC FIELDS EMANATING FROM A PERSON IN OR ON A BODY OF WATER

BACKGROUND

The field of the present invention relates to apparel worn by a person in or on a body of water. In particular, methods and apparel are disclosed for attenuating electromagnetic fields emanating from a person in or on a body of water.

The subject matter disclosed or claimed herein may be related to subject matter disclosed or claimed in: (i) U.S. non-provisional application Ser. No. 12/347,967 filed Dec. 31, 2008 in the names of Michael D. Slinkard and John M. Maupin and entitled "Methods and apparel for attenuating electromagnetic fields emanating from a hunter," (ii) U.S. non-provisional application Ser. No. 12/347,971 filed Dec. 3, 2008 in the names of Michael D. Slinkard and John M. Maupin and entitled "Methods and hunting blind for attenuating electromagnetic fields emanating from a hunter," and (iii) U.S. non-provisional application Ser. No. 12/428,763 filed Apr. 23, 2009 in the names of Michael D. Slinkard and John M. Maupin and entitled "Methods and apparel for attenuating electromagnetic fields emanating from an animal handler." Each of said applications is incorporated by reference as if fully set forth herein.

It is known that the human body generates electromagnetic fields during normal body functions, and that those fields can increase in strength with increased activity, excitement, emotion, or attention. For example, brain activity, nerve activity, and muscle activity all result in electric fields that emanate from the body. Detection and characterization of such fields is the basis for the conventional clinical techniques of electrocardiography (i.e., ECG or EKG), electroencephalography (i.e., EEG), and electromyelography (i.e., EMG). For the purposes of the present disclosure or claims, "electromagnetic" is intended to denote those fields that have temporal variations well below so-called optical frequencies (i.e., having frequency components no greater than about 1 gigahertz (GHz), typically no greater than about 1 megahertz (MHz), and often no greater than about 1 kilohertz (kHz).

It is also known that at least some animals can detect or respond to electromagnetic fields. For example, sharks detect electric fields emanating from prey by means of special sensing organs called the ampullae of Lorenzini (http://en.wikipedia.org/wiki/Ampullae_of_Lorenzini). A shark-repelling system is disclosed in U.S. Pat. No. 4,211,980 that generates an electric field to drive away the sharks. Other animals are believed to navigate their natural migratory routes using the earth's magnetic field (http://www.pbs.org/wgbh/nova/magnetic/animals.html).

Fabrics exist that are adapted to attenuate or block electromagnetic fields. They typically include electrically conductive fibers (metal, carbon nanotubes, or other conductive fibers) incorporated into the fabric along with more typical textile fibers. Garments constructed from such fabrics are conventionally used to shield a human wearer from surrounding electromagnetic fields. Such shielding can be usefully employed into safety equipment or apparel, can be worn by or applied to a patient to provide various health or therapeutic benefits, or for other purposes. Examples of such fabrics and their uses can be found in the following references, each of which is incorporated by reference as if fully set forth herein:

U.S. Pat. No. 7,354,877 entitled "Carbon nanotube fabrics" issued Apr. 8, 2008 to Rosenberger et al;

U.S. Pat. No. 6,868,854 entitled "Method and article for treatment of fibromyalgia" issued Mar. 22, 2005 to Kempe;

Pat. Pub. No. 2004/0053780 entitled "Method for fabricating nanotube yarn" published Mar. 18, 2004 in the names of Jiang et al;

U.S. Pat. No. 6,265,466 entitled "Electromagnetic shielding composite comprising nanotubes" issued Jul. 24, 2001 to Glatkowski et al;

U.S. Pat. No. 6,146,351 entitled "Method of reducing delayed onset muscle soreness" issued Nov. 14, 2000 to Kempe;

U.S. Pat. No. 5,621,188 entitled "Air permeable electromagnetic shielding medium" issued Apr. 15, 1997 to Lee et al;

U.S. Pat. No. 4,825,877 entitled "Method of pain reduction using radiation-shielding textiles" issued May 2, 1989 to Kempe; and U.S. Pat. No. 4,653,473 entitled "Method and article for pain reduction using radiation-shielding textile" issued Mar. 31, 1987 to Kempe.

There is no teaching or suggestion in the prior art to attenuate or block electromagnetic fields emanating from a human body, or that such attenuation or blocking would be desirable.

SUMMARY

A method comprises attenuating, while in or on a body of water, one's own emanated electromagnetic field by wearing at least one article of apparel that includes an electromagnetically shielding fabric. The shielding fabric comprises a substantially continuous system of conductive fibers combined with a non-conductive fabric. The attenuation of one's own emanated electromagnetic field decreases the likelihood of being located in the body of water by a predator detecting the emanated electromagnetic field.

Another method comprises attenuating the electromagnetic field emanated by a person in or on a body of water. The attenuation is accomplished by (i) providing to the person at least one article of apparel that includes the electromagnetically shielding fabric, and (ii) instructing the person to wear, while in or on a body of water, at least one said article of apparel. The attenuation of the electromagnetic field emanated by the person decreases the likelihood of a predator in the body of water locating the person by detecting the emanated electromagnetic field.

Objects and advantages pertaining to apparel incorporating electromagnetic shielding fabric may become apparent upon referring to the exemplary embodiments illustrated in the drawings and disclosed in the following written description or appended claims.

BRIEF DESCRIPTION OF THE DRAWINGS

FIGS. 4A and 4B illustrate exemplary electromagnetically shielding fabrics.

The embodiments shown in the Figures are exemplary, and should not be construed as limiting the scope of the present disclosure or appended claims.

DETAILED DESCRIPTION OF EMBODIMENTS

Figure 2:
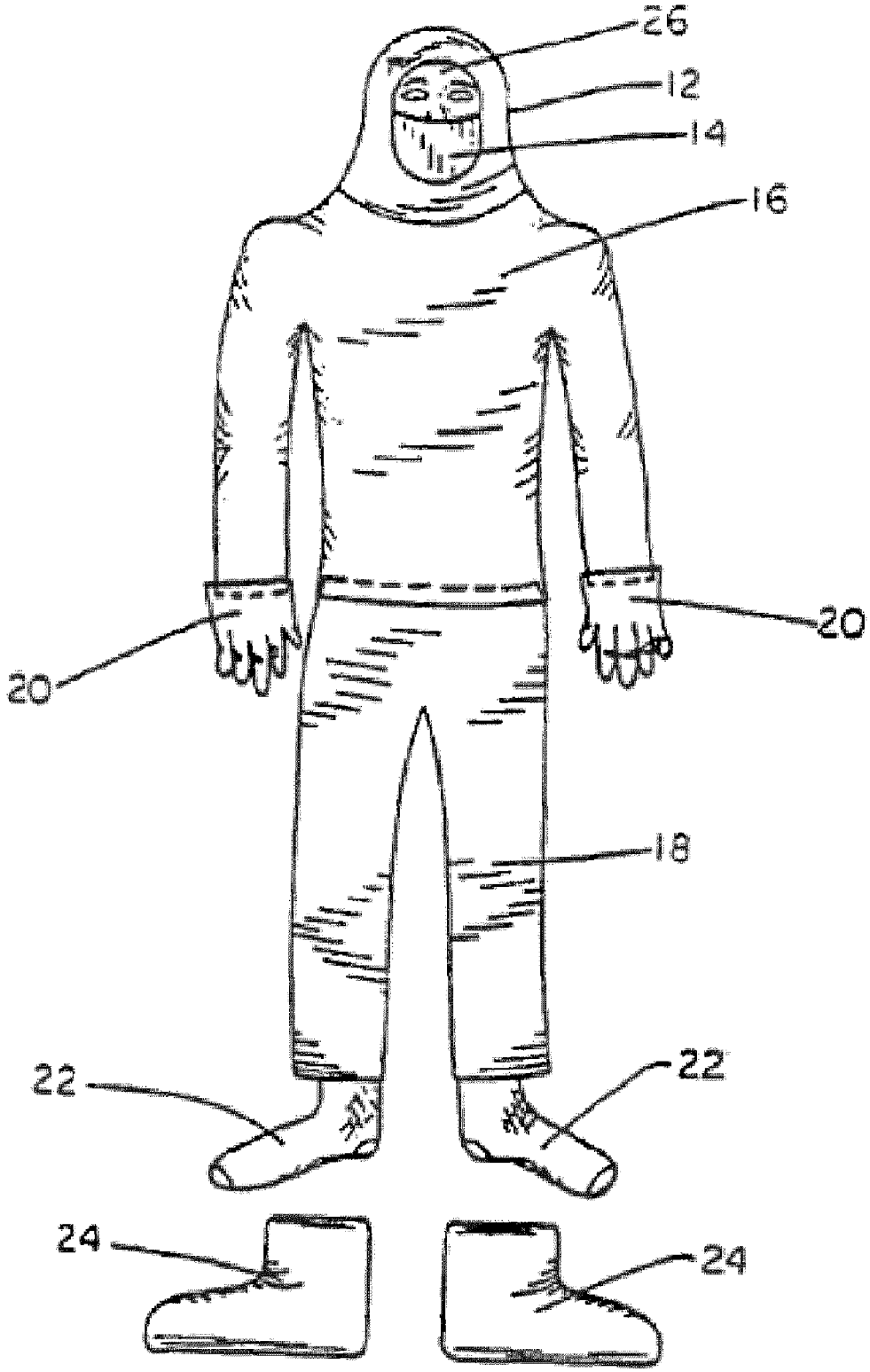
FIG. 2 illustrates various exemplary articles of electromagnetically shielding apparel.
Figure 5A:
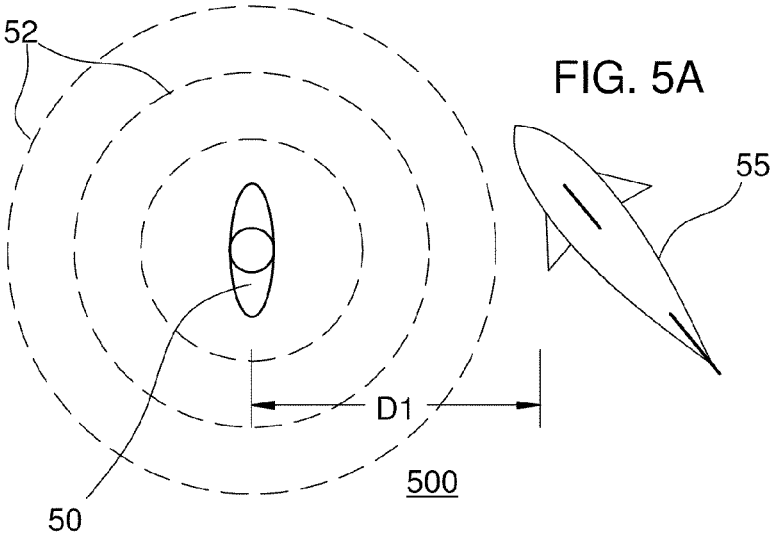
FIGS. 5A and 5B are schematic top views illustrating the approach of a water-borne predator toward a person in a body of water with and without, respectively, electromagnetically shielding apparel.
Figure 5B:
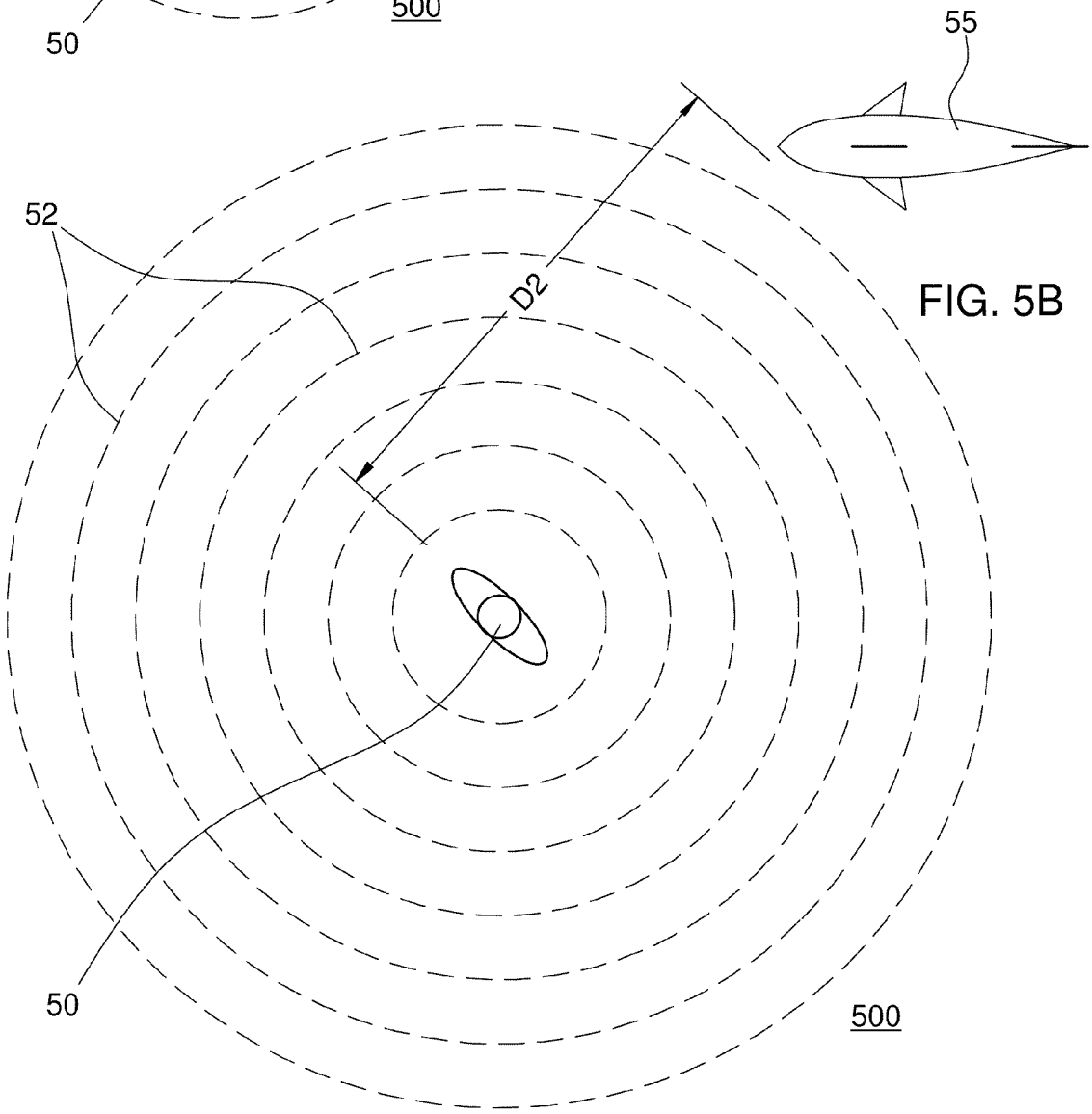

Electromagnetically shielding apparel can be advantageously employed during a variety of activities or in a variety of situations. In one example, such electromagnetic shielding can be incorporated into any suitable apparel worn while the wearer 50 is in or on a body of water 500 (e.g., river, lake, sea, ocean), as in FIGS. 5A-5B. Blocking or attenuating the electromagnetic field 52 emanated by the person 50 can reduce the likelihood of detection of the wearer 50 by an aquatic or marine water-borne predator 55, e.g., a shark. Without electromagnetically shielding apparel (as in FIG. 5B), the predator 55 might detect the person in the water from a larger distance D2. With electromagnetically shielding apparel (as in FIG. 5A), the predator 55 might only detect the person 50 in the water after approaching more closely (distance D1 that is smaller than distance D2). Shielding of a person's emanated electromagnetic field while in a body of water can be particularly advantageous under conditions of poor underwater visibility, wherein a water-borne predator might rely more heavily on electromagnetic prey detection, and wherein a person would have more difficulty seeing and avoiding a water-borne predator. Electromagnetically shielding apparel can be provided to or worn by, e.g., bathers, waders, swimmers, surfers, boaters, sailors, personal water craft users, wind surfers, para-sailors, para-surfers, snorkelers, or divers (free, scuba, or other) in a river, lake, sea, ocean, or other body of water. Examples of suitable articles of apparel can include, but are not limited to, trunks, shirts, bathing suits, wet suits, dry suits, deck apparel, and so on. Some examples are shown in FIG. 2. Electromagnetically shielding apparel can be included with other water survival gear on a vessel or aircraft, or electromagnetically shielding fabric can be incorporated into conventional survival gear, e.g., a life vest, life raft, or exposure suit. There is no teaching or suggestion in the prior art to attenuate or block electromagnetic fields emanating from a person in or on a body of water, or that such attenuation or blocking would be desirable.

Another exemplary method comprises attenuating, while hunting, the electromagnetic field emanated by a hunter. The electromagnetic field is attenuated by at least one article of apparel worn by the hunter while hunting. The article comprises an electromagnetically shielding fabric, which fabric comprises a substantially continuous system of conductive fibers combined with a non-conductive fabric. Another method can include providing at least one such article of electromagnetically shielding apparel to a hunter and instructing that hunter to wear the article while hunting. That method can also include constructing at least one said article of apparel prior to providing it to the hunter. There is no teaching or suggestion in the prior art to attenuate or block electromagnetic fields emanating from a hunter while hunting (or an observer while observing wildlife), or that such attenuation or blocking would be desirable.

By attenuating or blocking electromagnetic fields emanating from a hunter or observer, that hunter or observer can more closely approach an animal without detection, or detection of that hunter or observer by the animal can be made less likely. It is therefore desirable to provide hunting apparel (including, e.g., clothing, eyewear, headwear) or a hunting blind that attenuates or blocks electromagnetic fields emanating from the hunter or observer, thereby decreasing the likelihood of detection of the hunter or observer by an animal that is sensitive to electromagnetic fields, and increasing the likelihood that the hunter will be successful in taking the animal, or that the observer will be successful in making the desired observation of the animal.

Figure 1A:
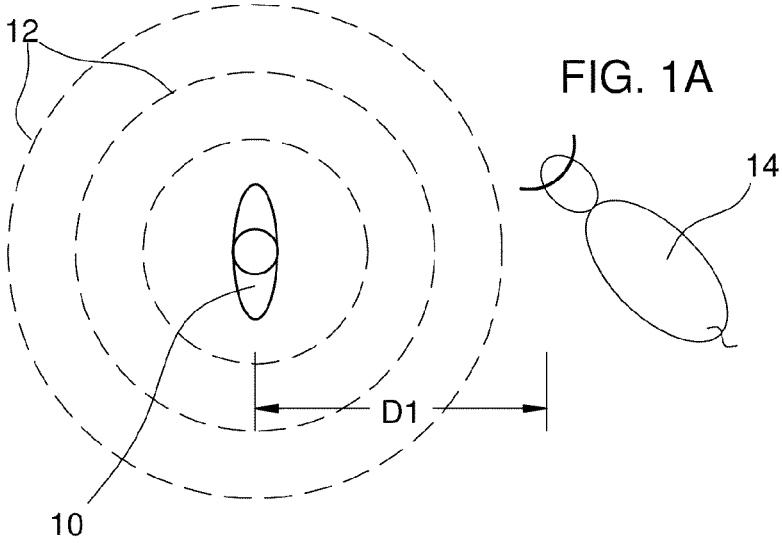
FIGS. 1A and 1B are schematic top views illustrating the approach of a hunter toward a prey animal (or vice versa) with and without, respectively, electromagnetically shielding apparel or hunting blind.
Figure 1B:
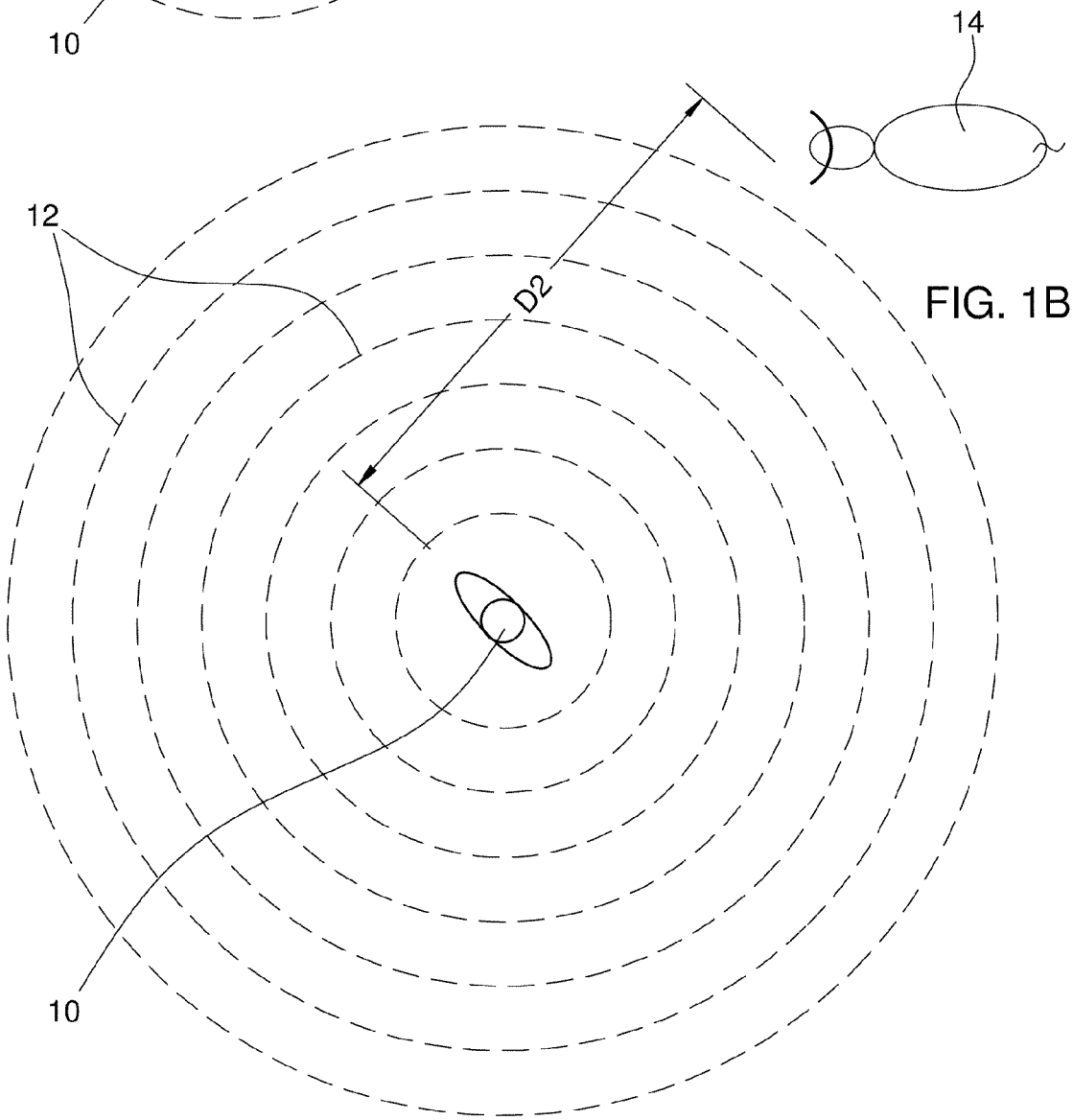

The hunter wears the article of apparel while hunting. The electromagnetically shielding fabric blocks or attenuates an electromagnetic field emanating from the hunter's body, thereby decreasing the likelihood that he or she will be detected by a prey animal sensitive to such electromagnetic fields. An electromagnetic field 12 emanated by a hunter 10 and thus attenuated can be detected by an animal 14 at a maximum distance D1 (FIG. 1A) that is smaller than the maximum detection distance D2 at which an unattenuated field 12 (FIG. 1B) can be detected by that same animal 14. The hunter 10 can therefore approach the animal 14 more closely without detection, facilitating the kill. In measurements of electromagnetic fields emanating from a human body, reductions of field strength ranging from about 38% to about 65% have been observed, as shown illustrated in the experimental results disclosed in an Appendix attached to application Ser. Nos. 12/347,967, 12/347,971, and 12/428,763 (already incorporated by reference). Any suitable, desirable, or practicable reduction of emanated electromagnetic field strength shall fall within the scope of the present disclosure or appended claims.

It is possible in some instances of hunting that a human hunter might become the prey of a predatory animal, either the animal he is hunting or another animal in the same habitat. In those circumstances, the electromagnetically shielding apparel can reduce the likelihood that the predatory animal will locate the human hunter by detecting the electromagnetic field emanated by the hunter.

As illustrated by the examples of FIG. 2, an article of hunting apparel incorporating electromagnetically shielding fabric can comprise an article of clothing (e.g., pants 18, shorts, shirt 16, undergarments, leggings, sleeves, gloves 20, mittens, jacket, coat, vest, overalls, waders, or snowsuit), footwear (e.g., shoes, boots 24, socks 22, or boot liners), headwear (e.g., hood 12, facemask 14, or hat), or eyewear (e.g., glasses or goggles 26).

Another exemplary method comprises attenuating, while handling an animal, the electromagnetic field emanated by a handler of the animal. The electromagnetic field is attenuated by at least one article of apparel worn by the handler while handling the animal. The article of apparel comprises an electromagnetically shielding fabric, which fabric comprises a substantially continuous system of conductive fibers combined with a non-conductive fabric. Another method can include providing at least one such article of electromagnetically shielding apparel to a handler and instructing that handler to wear the article while handling the animal. That method can also include constructing at least one said article of apparel prior to providing it to the handler. There is no teaching or suggestion in the prior art to attenuate or block electromagnetic fields emanating from an animal handler while handling an animal, or that such attenuation or blocking would be desirable.

Attenuating or blocking electromagnetic fields emanating from a person can be advantageous while handling an animal. It has been observed frequently that animals can be affected by emotional responses or the emotional state of a person nearby, e.g., a person's anxiety can cause nervous or uneasy behavior of the animal, or a person's fear can trigger an aggressive response from the animal. Sensing by an animal of a person's emotional state or response might occur in a variety of ways, e.g., by detecting by smell pheromones released as a result of the person's emotional state or response, or by sensing emotion-related electromagnetic fields resulting from the person's emotional state or responses. Attenuating or blocking fields emanating from the person can advantageously reduce the effect on the animal of the emotional state or an emotional response of the person.

"Handling" an animal shall encompass, inter alia: (i) literal handling of the animal by holding or touching the animal; (ii) handling the animal using a rope, chain, leash, muzzle, harness, saddle, reins, yoke, prod, whip, or other equipment; (iii) feeding the animal; (iv) guiding, directing, herding, capturing, or restraining the animal; (v) riding the animal; (vi) using the animal to pull or push a vehicle, object, or equipment of any sort; (vii) using the animal in a performance, display, or demonstration; (viii) training the animal for any purpose, including but not limited to those listed here; (ix) conducting veterinary examination or treatment of the animal; (x) using an animal to train another handler to perform any animal-handling task, including but not limited to those listed here; (xi) using an animal to learn from another handler to perform any animal-handling task, including but not limited to those listed here; and (xii) other activities that involve interaction between a person and an animal.

An animal handler wears the article of electromagnetically shielding apparel while handling the animal. Instead or in addition, other people likely to be near the animal (i.e., bystanders) can wear articles of electromagnetically shielding apparel; for purposes of the present disclosure or appended claims, the terms "handler" and "handling" shall be construed as including both those persons interacting directly with the animal as well as bystanders that might interact with the animal indirectly (e.g., by being near enough to affect the animal via pheromones or emanated electromagnetic fields). By blocking or attenuating electromagnetic fields emanating from a person near the animal, the animal is less likely to sense such fields that arise from an emotional response or state of the person, and is therefore also less likely to react to that emotional state or reaction. In particular, emotional responses or states that might cause undesirable behavior of the animal (e.g., flight or aggression) are less likely to be sensed by the animal. Such emotional states or responses can arise for a variety of reasons, e.g., a handler's or bystander's fear of the animal, a handler's frustration with the animal's behavior or response (or lack thereof) to its training, a handler's frustration or discomfort while being taught how to handle an animal, or an instructor's frustration at a handler trainee's response (or lack thereof) to his/her instruction.

Any other use of electromagnetically shielding clothing, in a situation wherein blocking or attenuation of the wearer's emanated electromagnetic field may be advantageous, shall fall within the scope of the present disclosure, whether that situation involves an animal or not. The electromagnetically shielding fabric may block or attenuate electric fields, magnetic fields, or both, and any of those alternative shall fall within the scope of the present disclosure or appended claims. It may be preferable under particular circumstances to preferentially block either electric fields or magnetic fields, and such uses are encompassed by the present disclosure or appended claims.

Figure 3A:
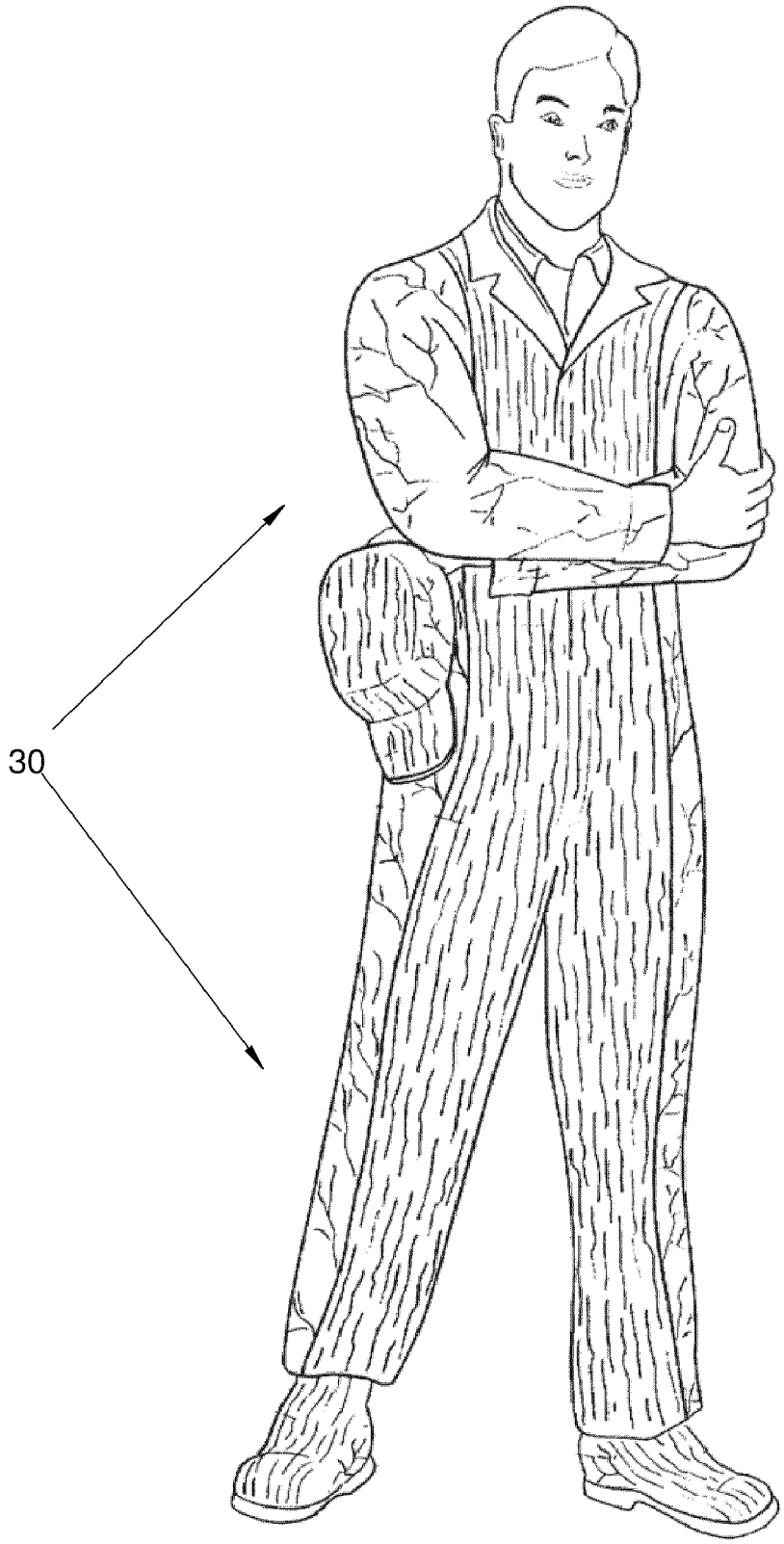
FIGS. 3A and 3B illustrate exemplary articles of electromagnetically shielding apparel that include exemplary visual camouflage patterns.
Figure 3B:
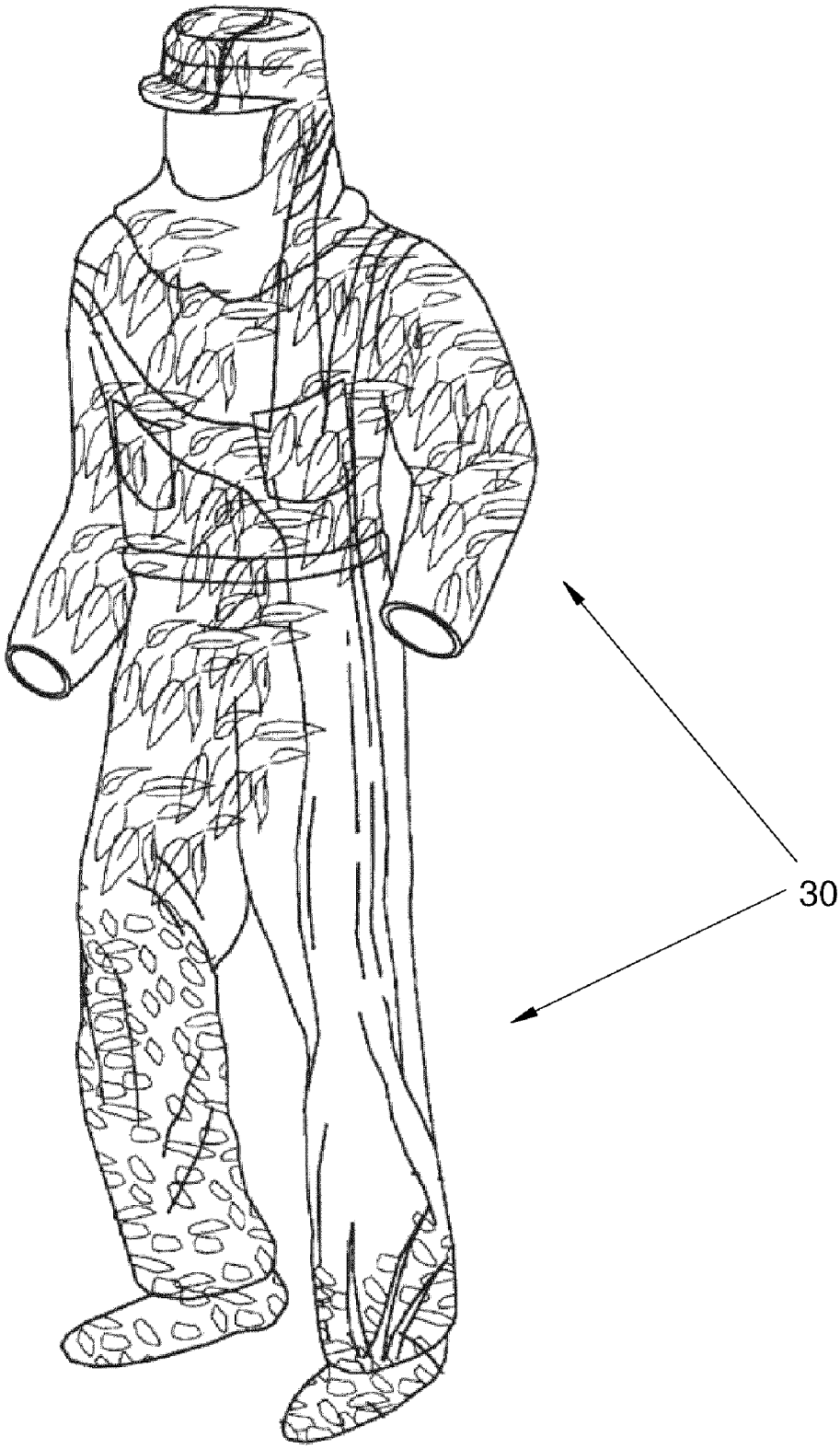

In addition to providing electromagnetic shielding, the article of apparel can also be adapted or arranged to decrease visual or olfactory perception of the hunter by a prey animal or predatory animal, or of a person in a body of water by a water-borne predator. For example, articles of apparel 30 can include a visual camouflage pattern on at least a portion of its outer surface (as in FIGS. 3A and 3B). Many examples of such visual camouflage are known, and some examples are disclosed in various of the incorporated references. Any suitable visual camouflage pattern, including both two- and three-dimensional patterns, shall fall within the scope of the present disclosure or claims. In another example, the article of apparel can include an odor absorber, suppressant, attenuator, or blocker. Some examples of these are disclosed in various of the incorporated references. Any suitable odor absorber, suppressant, attenuator, or blocker shall fall within the scope of the present disclosure or claims. By combining electromagnetic shielding with visual camouflage or odor control, the overall likelihood that the hunter will be detected by a prey animal can be decreased, and the probability of a successful kill can be increased. Use of odor control can also reduce the likelihood that an animal will sense (via pheromones) and react to an emotional response or the emotional state of a handler.

Any suitable fabric can be employed that incorporates conductive fibers of any suitable type to form a substantially continuous electrical conduction network in the fabric. The conduction network 42 can be arranged irregularly (as in the example of FIG. 4A), in a grid-like pattern (as in the example of FIG. 4B), or in any other suitable, desirable, or practicable arrangement. The conductive fibers can be intermingled with non-conductive fibers 44 to form the shielding fabric 40 (in a regular, interwoven arrangement or in an irregular arrangement). Examples of suitable fibers include typical textile fibers, e.g., wool, silk, or other natural polyamide fibers; cotton, rayon, or other cellulosic fibers; or nylon, polyester, Kevlar, or other synthetic fibers. Alternatively, the conductive fibers 42 (regularly or irregularly arranged) can be applied to a surface of a non-conducting fabric 46 to form the shielding fabric 40. In that latter case, the non-conducting fabric can comprise a woven, textile fabric, or can comprise a substantially continuous sheet fabric such as a plastic sheet or polymer film. The conductive fibers can be combined with the non-conducting fabric in any suitable, desirable, or practicable way, including those described above or others not explicitly disclosed herein, and all such combinations shall fall within the scope of the present disclosure or appended claims.

Any suitable conductive fibers can be employed that provide sufficient conductivity for providing electromagnetic shielding and that can form fibers suitable for incorporation into a fabric. In various examples disclosed in the incorporated references, the conductive fibers comprise stainless steel, copper, silver, carbon (e.g., fibers, graphite, or nanotubes), conductive ceramic, conductive polymer, or conductive nanotubes. Any suitable composition of the electromagnetic shielding fabric can be employed. One suitable example is Farabloc® fabric described in incorporated U.S. Pat. Nos. 4,653,473, 4,825,877, 6,146,351, and 6,868,854. In various examples of such fabrics disclosed in the incorporated references, the fabric includes between about 2% and about 35% by weight of the conductive fibers. Other exemplary fabrics can include greater than about 5%, greater than about 10%, greater than about 15%, greater than about 20%, greater than about 25%, or greater than about 30% by weight of the conductive fibers, while still other exemplary fabrics can include less than about 30%, less than about 25%, less than about 20%, less than about 15%, less than about 10%, or less than about 5% by weight of the conductive fibers. Fabrics having greater than 35% by weight of conductive fibers can be employed if suitable, desirable, or practicable. Higher compositions of conductive fiber typically can provide greater electromagnetic shielding, but might also come at a higher cost or weight, or might yield a fabric with other undesirable properties. Any suitably optimized composition can be used in a given situation.

A number of case studies are presented in application Ser. Nos. 12/347,967, 12/347,971, and 12/428,763 (already incorporated by reference). Those case studies demonstrate the effectiveness of garments incorporating electromagnetically shielding fabric for decreasing the likelihood of detection by prey animals while hunting. In addition to the case studies, a more controlled, systematic test of the effect of electromagnetically shielding fabric on animals' perception of the electromagnetic field emanating from a human body is disclosed in a manuscript reproduced in an Appendix attached to those incorporated applications.

Another exemplary method comprises attenuating, while hunting, the electromagnetic field emanated by a hunter within a hunting blind. The hunting blind includes an electromagnetically shielding fabric of any suitable type described herein. Another method can include providing an electromagnetically shielding hunting blind to a hunter and instructing that hunter to remain within the hunting blind while hunting. That method can also include constructing the hunting blind prior to providing it to the hunter. There is no teaching or suggestion in the prior art to incorporate electromagnetically shielding fabric into hunting apparel or a hunting blind, or that the incorporation of such fabrics would be desirable.

A several examples of a hunting blind are shown in application Ser. Nos. 12/347,967, 12/347,971, and 12/428,763 (already incorporated by reference). A hunting blind can include electromagnetically shielding fabric arranged to attenuate the electromagnetic field emanating from a hunter within the hunting blind. The attenuation of the hunter's electromagnetic field enables prey animals to approach the blind more closely before perceiving the hunter's presence within the blind.

The hunting blind can be arranged in any suitable configuration while remaining within the scope of the present disclosure or appended claims. Many examples of hunting blinds can be found in the prior art (some of which are cited above), and any of them can incorporate electromagnetically shielding fabric to attenuate the electromagnetic field emanating from a hunter within the hunting blind. The electromagnetically shielding fabric can be integrated into the structure of the hunting blind, or can be provided as a add-on covering or lining for an existing hunting blind. It may be desirable in many circumstances to arrange the shielding fabric of the hunting blind to substantially completely enclose the hunter in all directions (except for openings provided for viewing the prey and for shooting through), although such complete enclosure may not always be necessary. If the hunting blind is elevated and if such complete enclosure is desired, the shielding fabric can be incorporated into the bottom surface of the blind (below the hunter) as well as into the blind's other surfaces. If the hunting blind rests on the ground, the shielding fabric can be incorporated into the bottom surface of the blind, the shielding fabric can be omitted from the bottom surface, or the blind may not even have a bottom surface; the ground can provide electromagnetic shielding in a downward direction if no shielding fabric is present below the hunter. Blinds that do not substantially enclose the hunter shall also fall within the scope of the present disclosure or appended claims. As with the articles of hunting apparel disclosed above, a hunting blind that incorporates electromagnetically shielding fabric can also include a visual camouflage pattern on at least a portion of its outer surface, or can also include an odor absorber, suppressant, attenuator, or blocker. Any suitable fabric composition (e.g., Farabloc®) can be incorporated into a hunting blind.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . .", or similar language; or (ii) two or more of the listed alternatives are mutually exclusive within the particular context, in which case "or" would encompass only those combinations involving non-mutually-exclusive alternatives. For purposes of the present disclosure or appended claims, all instances of the words "comprising," "including," "having," and variants thereof shall be construed as open ended terminology, with the same meaning as if the phrase "at least" were appended after each instance thereof.

What is claimed is:

1. A method comprising attenuating, while in or on a body of water, one's own emanated electromagnetic field by wearing at least one article of apparel that includes an electromagnetically shielding fabric, which shielding fabric comprises a substantially continuous system of conductive fibers combined with a non-conductive fabric and attenuates the emanated electromagnetic field at frequencies less than about 1 gigahertz, wherein said attenuating of one's own emanated electromagnetic field at frequencies less than about 1 gigahertz decreases the likelihood of being located in the body of water by a water-borne non-human animal predator detecting one's own emanated electromagnetic field.

2. The method of claim 1 wherein the conductive fibers are intermingled with non-conductive fibers that form the non-conducting fabric.

3. The method of claim 1 wherein the conductive fibers are applied to a surface of the non-conducting fabric.

4. The method of claim 1 wherein at least one said article of apparel comprises an article of clothing, footwear, headwear, or eyewear.

5. The method of claim 1 wherein at least one said article of apparel includes a visual camouflage pattern on at least a portion of its outer surface.

6. The method of claim 1 wherein at least one said article of apparel includes an odor absorber, suppressant, attenuator, or blocker.

7. The method of claim 1 wherein the shielding fabric includes between about 2% and about 35% by weight of the conductive fibers.

8. The method of claim 1 wherein the conductive fibers comprise carbon fibers or nanotubes.

9. The method of claim 1 wherein the conductive fibers comprise stainless steel, copper, silver, carbon fibers or nanotubes, conductive ceramic, conductive polymer, or conductive nanotubes.

10. A method comprising attenuating, while a user is in or on a body of water, the user's emanated electromagnetic field by:

providing to the user at least one article of apparel that includes an electromagnetically shielding fabric, which shielding fabric comprises a substantially continuous system of conductive fibers combined with a non-conductive fabric and attenuates the emanated electromagnetic field at frequencies less than about 1 gigahertz; and instructing the user to wear, while in or on the body of water, at least one said article of apparel, wherein said attenuating of the user's emanated electromagnetic field at frequencies less than about 1 gigahertz decreases the likelihood of the user being located in the body of water by a water-borne non-human animal predator detecting the user's emanated electromagnetic field.

11. The method of claim 10 wherein the conductive fibers are intermingled with non-conductive fibers that form the non-conducting fabric.

12. The method of claim 10 wherein the conductive fibers are applied to a surface of the non-conducting fabric.

13. The method of claim 10 wherein at least one said article of apparel comprises an article of clothing, footwear, headwear, or eyewear.

14. The method of claim 10 further comprising constructing at least one said article of apparel prior to providing it to the user.

15. The method of claim 10 wherein at least one said article of apparel includes a visual camouflage pattern on at least a portion of its outer surface.

16. The method of claim 10 wherein at least one said article of apparel includes an odor absorber, suppressant, attenuator, or blocker.

17. The method of claim 10 wherein the shielding fabric includes between about 2% and about 35% by weight of the conductive fibers.

18. The method of claim 10 wherein the conductive fibers comprise carbon fibers or nanotubes.

19. The method of claim 10 wherein the conductive fibers comprise stainless steel, copper, silver, carbon fiber or nanotubes, conductive ceramic, conductive polymer, or conductive nanotubes.

20. The method of claim 1 wherein the electromagnetically shielding fabric attenuates the emanated electromagnetic field at frequencies less than about 1 megahertz, and said attenuating of one's own emanated electromagnetic field at frequencies less than about 1 megahertz decreases the likelihood of being located in the body of water by a water-borne non-human animal predator detecting one's own emanated electromagnetic field.

21. The method of claim 1 wherein the electromagnetically shielding fabric attenuates the emanated electromagnetic field at frequencies less than about 1 kilohertz, and said attenuating of one's own emanated electromagnetic field at frequencies less than about 1 kilohertz decreases the likelihood of being located in the body of water by a water-borne non-human animal predator detecting one's own emanated electromagnetic field.

22. The method of claim 10 wherein the electromagnetically shielding fabric attenuates the emanated electromagnetic field at frequencies less than about 1 megahertz, and said attenuating of the user's emanated electromagnetic field at frequencies less than about 1 megahertz decreases the likelihood of the user being located in the body of water by a water-borne non-human animal predator detecting the user's emanated electromagnetic field.

23. The method of claim 10 wherein the electromagnetically shielding fabric attenuates the emanated electromagnetic field at frequencies less than about 1 kilohertz, and said attenuating of the user's emanated electromagnetic field at frequencies less than about 1 kilohertz decreases the likelihood of the user being located in the body of water by a water-borne non-human animal predator detecting the user's emanated electromagnetic field.

* * * * *